US009556699B2

(12) United States Patent
Liew

(10) Patent No.: US 9,556,699 B2
(45) Date of Patent: Jan. 31, 2017

(54) HYDRAULIC CONDUCTOR PIPE CONNECTOR

(71) Applicant: GE Oil & Gas Pressure Control LP, Houston, TX (US)

(72) Inventor: Joseph Shu Yian Liew, Singapore (SG)

(73) Assignee: GE OIL & GAS PRESSURE CONTROL LP, Houston, TX (US)

( * ) Notice: Subject to any disclaimer, the term of this patent is extended or adjusted under 35 U.S.C. 154(b) by 169 days.

(21) Appl. No.: 14/471,460

(22) Filed: Aug. 28, 2014

(65) Prior Publication Data

US 2016/0060994 A1 Mar. 3, 2016

(51) Int. Cl.

| | |
|---|---|
| ***E21B 33/04*** | (2006.01) |
| ***E21B 33/03*** | (2006.01) |
| ***E21B 19/10*** | (2006.01) |

(52) U.S. Cl.

CPC ..... *E21B 33/0422* (2013.01); *E21B 19/10* (2013.01); *E21B 33/03* (2013.01)

(58) Field of Classification Search

USPC ..... 166/379, 77.51

See application file for complete search history.

(56) References Cited

U.S. PATENT DOCUMENTS

| | | | | |
|---|---|---|---|---|
| 4,856,594 A | | 8/1989 | Jennings | |
| 4,936,382 A | | 6/1990 | Thomas | |
| 5,158,326 A | * | 10/1992 | Anderson | E21B 33/0422 285/123.9 |
| 6,138,762 A | | 10/2000 | Sweeney | |
| 8,474,537 B2 | | 7/2013 | Voss | |
| 2003/0121653 A1 | | 7/2003 | Webster | |

FOREIGN PATENT DOCUMENTS

GB 2233687 A 1/1991

OTHER PUBLICATIONS

A PCT Search Report and Written Opinion issued in connection with corresponding PCT Application No. PCT/US2015046442 on Oct. 29, 2015.

* cited by examiner

*Primary Examiner* — Taras P Bemko
(74) *Attorney, Agent, or Firm* — Hogan Lovells US LLP

(57) ABSTRACT

A conductor pipe connector assembly for coupling a pressure containing component to a conductor pipe of a subterranean well includes an annular slip bowl circumscribing the conductor pipe. An annular slip segment is located between the slip bowl and the conductor pipe. A slip actuation ring is located between the slip bowl and the slip segment, the slip actuation ring having a beveled surface in sliding contact with one of the slip bowl and the slip segment. An elongate annular piston member circumscribes the conductor pipe and is coupled to the slip action ring, the piston member is movable by a pressure medium, such as hydraulic fluid or pressurized gas, to an engaged position to urge the slip segment radially inward against the conductor pipe.

18 Claims, 4 Drawing Sheets

HYDRAULIC CONDUCTOR PIPE CONNECTOR

BACKGROUND

1. Field of the Disclosure

This invention relates in general to subterranean wells, and in particular to connectors for attaching to a conductor pipe associated with the subterranean well.

2. Description of Prior Art

In a subterranean well of the type concerned herein, a tubular member extends generally upwards from the subterranean well. Typically the tubular member can be casing, a drill string, or other conductor pipe that extends out of the subterranean well. A conductor pipe connector assembly connects the upper end of the conductor pipe to a pressure containing component, such as a surface wellhead, a multibowl component, or a drilling diverter system.

Many current connector assemblies are mechanical in nature. Such mechanical systems can be cumbersome in size with the mechanical components defining a relatively large outer diameter clearance to operate. In certain situations, the forces required to operate the mechanical connector can become so large that it is difficult for an operator to properly energize the connector.

SUMMARY OF THE DISCLOSURE

Methods and system of embodiments of the current disclosure provide a conductor pipe connector that can be used in close confines or restricted applications such as tight well slot allocations or overshot applications. Embodiments of this disclosure are able to engage rough conductor pipe and energize a seal between, the conductor pipe connector and the conductor pipe in a quick connect operation with no welding required. The use of hydraulics to control the conductor pipe connector provides ease of operations for engaging the conductor pipe with the conductor pipe connector as well as for releasing the conductor pipe connector from the conductor pipe. A Iranian operator does not have to physically provide the force or torque required to operate a mechanical connector and the conductor pipe connector does not require a clearance around the connector in order to manually reach the connector. Embodiments of the hydraulic conductor pipe connector of this disclosure can be modified to exclude any external lockdown members so that due to its slick outer diameter profile, the conductor pipe connector can be run through subsea wellheads or surface wellhead systems.

In an embodiment of tins disclosure, a conductor pipe connector assembly for coupling a pressure containing component to a conductor pipe of a subterranean well includes an annular slip bowl circumscribing the conductor pipe. An annular slip segment is located between the slip bowl and the conductor pipe. A slip actuation ring is located between the slip bowl and the slip segment, the slip actuation ring having a beveled surface in sliding contact with one of the slip bowl and the slip segment. An elongated annular piston member circumscribes the conductor pipe and is coupled to the slip actuation ring, the piston member movable to an engaged position to urge the slip segment radially inward against the conductor pipe.

In an alternate embodiment of this disclosure, a conductor pipe connector assembly for coupling a pressure containing component to a conductor pipe of a subterranean well includes a connector housing, the connector housing being annular with a housing central bore and a central axis. A slip bowl is located axially adjacent to, attached to, and coaxial with, the connector housing, the slip bowl being annular and having a bowl central bore. A slip segment is carried by the slip bowl. An annular seal is located within the housing central bore. A piston member is located within the housing central bore. The piston member is an elongated annular member movable to an engaged position where the piston member both energizes the annular seal to seal between, the connector housing and the conductor pipe and retains the slip segment In gripping engagement with the conductor pipe.

In yet another embodiment of this disclosure, a method for coupling a pressure containing component to a conductor pipe of a subterranean well includes providing a conductor pipe connector assembly. The conductor pipe connector assembly has a connector housing with a housing central bore, a slip bowl attached to, and coaxial, with, the connector housing and having a bowl central bore, a slip segment carried within the bowl central bore, an annular seal located within the housing central bore, and a piston member located within the housing central bore. The conductor pipe connector assembly is landed over an end of the conductor pipe so that the connector housing circumscribes a portion of the conductor pipe. A pressure media is injected into a supply port through the connector housing and into an engage pressure chamber defined between the piston member and the connector housing, to move the piston member towards an engaged position so that the annular seal is energized to seal between the connector housing and the conductor pipe, and the slip segment grips the conductor pipe.

BRIEF DESCRIPTION OF THE DRAWINGS

Some of the features and benefits of the present invention having been stated, others will become apparent as the description proceeds when taken in conjunction, with the accompanying drawings, in which.

DETAILED DESCRIPTION OF THE DISCLOSURE

Figure 1:
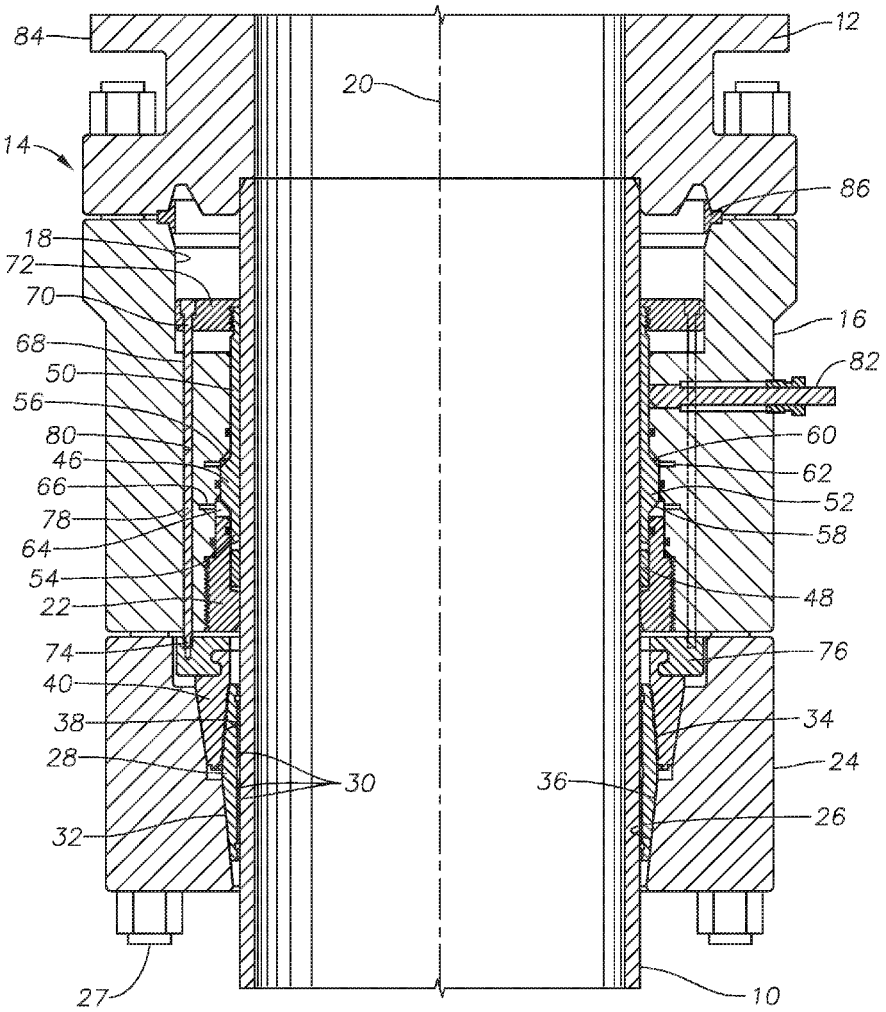
FIG. 1 is a section, view of a conductor pipe connector assembly of an embodiment of this disclosure, with, the piston member shown in an unengaged position.

The methods and systems of the present disclosure will sow be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIGS. 1-4, conductor pipe 10 is shown extending upwards from a subterranean well. Conductor pipe 10 can be, for example, casing extending from a shore based or subsea subterranean well (not shown) to a surface wellhead, a drill string extending from a shore based or offshore subterranean well, or a stuck tubing or casing of a shore based or subsea subterranean well. A flanged member 12 to be connected to conductor pipe 10. Flanged member 12 can be, for example, a pressure containing component such as surface wellhead, a multibowl component, or a drilling diverter system, in each case associated with either a shore based or subsea subterranean well. Alternately flanged member 12 can be a connector member that links between conductor pipe 10 and the pressure containing component, such as for example, conductor pipe connector assembly 14.

Figure 2:
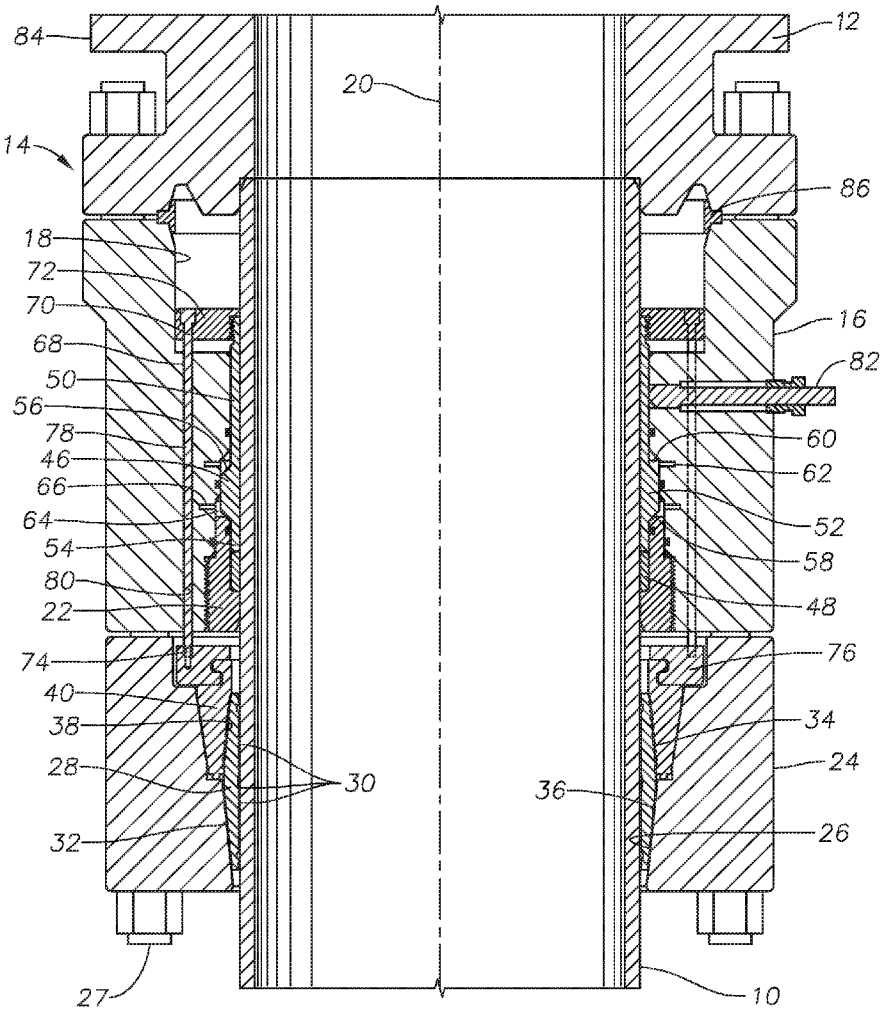
FIG. 2 is a section view of a portion of the conductor pipe connector assembly of FIG. 1, with the piston member shown in an engaged position.

Conductor pipe connector assembly 14 provides a connection between conductor pipe 10 and the pressure containing component. Conductor pipe connector assembly 14 includes a connector housing 16. Connector housing 16 is an annular shaped member with housing central bore 18 having central axis 20. Connector housing 16 can be a single solid member. Alternately, as shown in the embodiments of FIGS. 1-2, connector housing 16 can include an end cap 22 threaded to a lower portion of housing central bore 18 in order to ease the assembly process. End cap 22 is a ring shaped member with external threads that mate with internal threads of housing central bore 18. When fully threaded into housing central bore 18, a lower surface of end cap 22 is generally axially level with a tower surface of connector housing 16.

Returning to FIGS. 1-4, conductor pipe connector assembly 14 also includes slip bowl 24. Slip bowl 24 is an annular shaped member with bowl central bore 26 and circumscribes conductor pipe 10. Slip bowl 24 is located below and axially adjacent to connector housing 16. Slip bowl 24 is attached to the lower surface of connector housing 16 with connector members 27, which can be for example, bolts. Slip bowl 24 is coaxial with connector housing 16, sharing central axis 20.

Slip segment 28 is located within bowl central bore 26 radially between slip bowl 24 and conductor pipe 10. Slip segment 28 is generally ring shaped and concentric with bowl central bore 26. Slip segment 28 can be a single continuous ring except for a single cut through the axial length of slip segment 28, defining a gap in slip segment 28 and allowing slip segment 28 to expand and contract. Slip segment 28 has a generally axially extending inner surface with teeth 30 for engaging and gripping an outer-surface of conductor pipe 10.

The outer surface of slip segment 28 includes downward facing sloped surface 32 and upward facing sloped surface 34. Surfaces 32, 34 extend radially inward with distance from a mid-portion of slip segment 28 to give slip segment 28 a wedge like cross section. Downward facing sloped surface 32 mates with a bowl lower sloped surface 36. Bowl lower sloped surface 36 is a sloped surface facing in an upward direction on an inner diameter of bowl central bore 26 and is complimentary to slip segment 28. Slip segment 28 is fabricated to be biased in a radially outward direction so that slip segment 28 is constantly applying radially outward forces on bowl central bore 26 as it strains to expand radially outward. Because of the radially outward bias of slip segment 28, slip segment 28 protrudes into slip bowl 24. The mated interaction between downward facing sloped surface 32 and bowl lower sloped surface 36 allows slip segment 28 to be retained within bowl central bore 26 when conductor pipe connector assembly 14 is being lowered onto conductor pipe 10 and during other operations and handling of conductor pipe connector assembly 14.

Upward facing sloped surface 34 of slip segment 28 mates with inner sloped surface 38 of slip actuation ring 40. Slip actuation ring 40 is an annular member located in bowl central bore 26 radially between slip bowl 24 and slip segment 28 and has a beveled surface in sliding contact with one of slip bowl 24 or slip segment 28. Slip actuation ring 40 has a generally wedged shape in cross section, with an outer sloped surface that faces downward engaging an inner mating sloped surface of bowl central bore 26 that laces upward. Both the outer sloped surface of slip actuation ring 40 and the inner mating sloped surface of bowl central bore 26 can be smooth or with a slight grooved profile to reduce the surface drag. Slip actuation ring 40 is located axially above bowl lower sloped surface 36.

Figure 3:
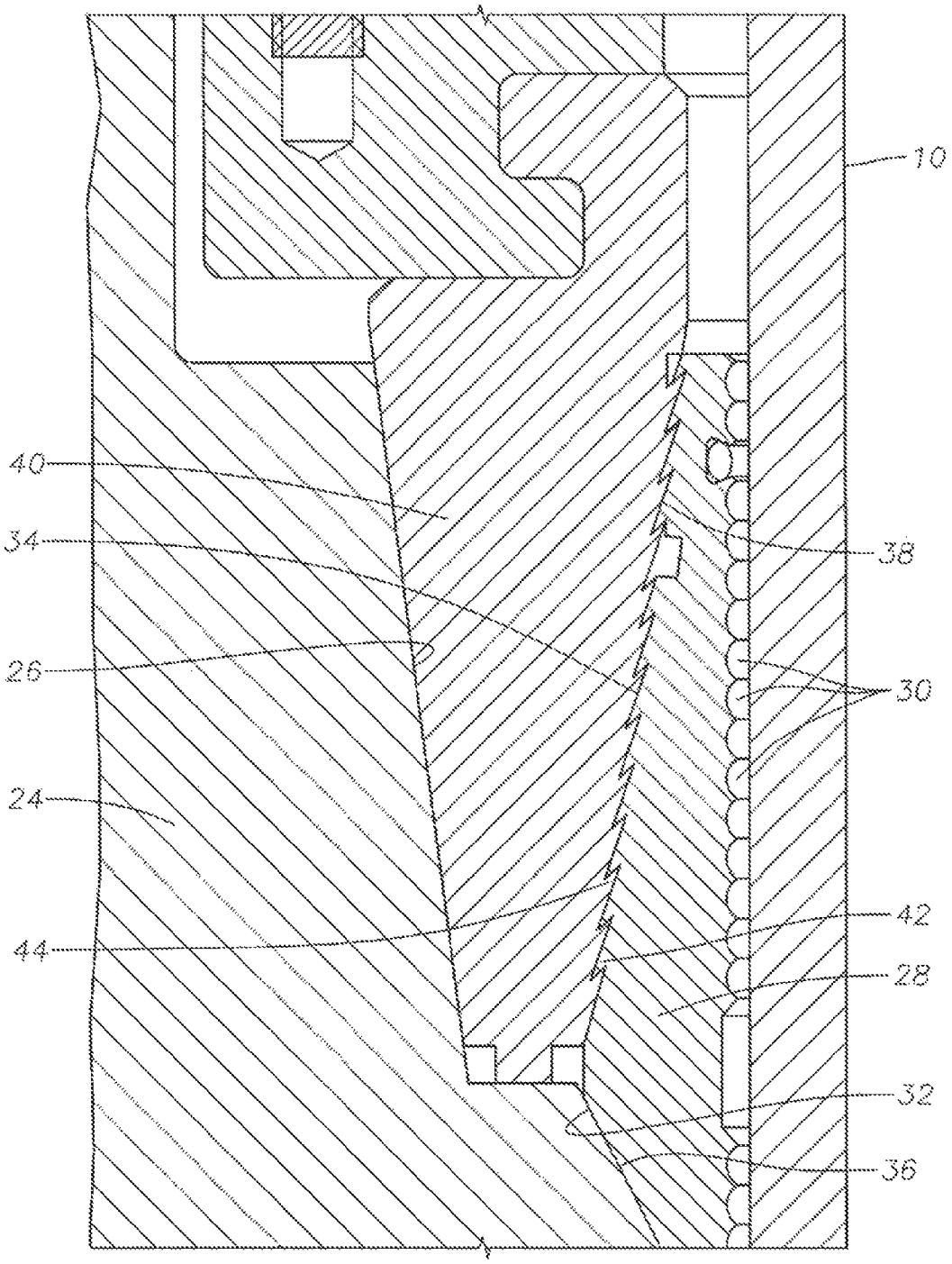
FIG. 3 is a section view of a portion of the conductor pipe connector assembly of FIG. 2, as indicated in FIG. 2.

Looking at FIG. 3, upward facing sloped surface 34 of slip segment 28 has a slips surface profile 42, and inner sloped surface 38 of actuation ring 40 has an actuation surface profile 44. Slips surface profile 42 and actuation surface profile 44 are shaped so that slip actuation ring 40 can move axially downward relative to slip segment 28, but when slip actuation ring 40 moves upward, slip segment 28 moves upward with slip actuation ring 40. More specifically, as an example, profiles 42, 44 each have a saw tooth like sectional shape that forms peaks. The peaks on slips surface profile 42 project generally downwardly, whereas the peaks on actuation surface profile 44 project generally upwardly.

Returning to FIGS. 1-4, as slip actuation ring 40 moves downward, the outer sloped surface of actuation ring 40 slides along the inner mating sloped surface of bowl central bore 26 and the inner sloped surface 38 of actuation ring 40 will slide along upward facing sloped surface 34 of slip segment 28 and will urge slip segment 28 axially downwards and radially inwards. As slip segment 28 moves downwards, it will also be urged inwards as downward facing sloped surface 32 of slip segment 28 interacts with bowl lower sloped surface 36. This will drive teeth 30 of slip segment 28 into gripping engagement with the outer surface of conductor pipe 10.

Conductor pipe connector assembly 14 includes piston member 46 for driving slip segment 28 into gripping engagement with the outer surface of conductor pipe 10. Piston member 46 is located within housing central bore 18 and is moveable between an unengaged position and an engaged position. In the engaged position, piston member 46 is in an axial lower location than when piston member 46 is in an unengaged position. In the engaged position, piston member 46 energizes an annular seal 48 to seal between conductor housing 16 and conductor pipe 10, and retains slip segment 28 in gripping engagement with conductor pipe 10. Annular seal 48 is located within housing central bore 18 for sealing between connector housing 16 and conductor pipe 10. Annular seal 48 can be, for example, an elastomer slab packing.

Figure 4:
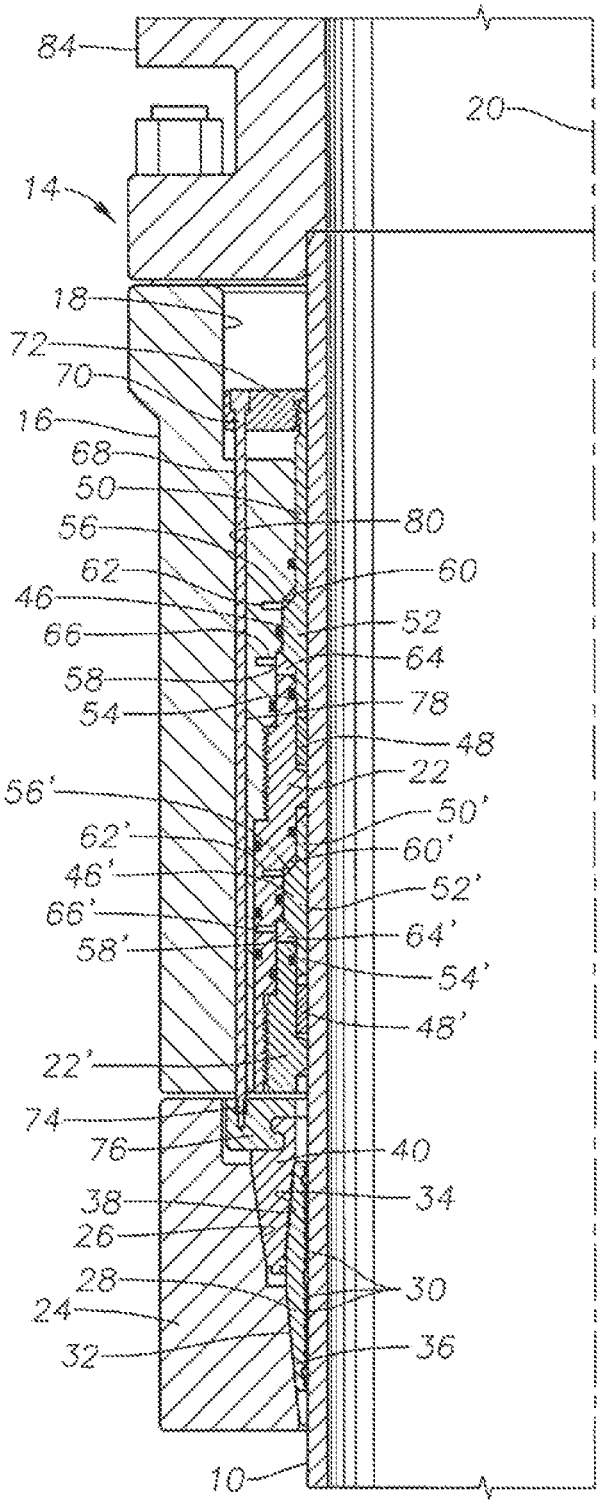
FIG. 4 is a section view of a portion of a conductor pipe connector assembly of an embodiment of this disclosure, with the piston member shown in an unengaged position and a second piston member shown in a second piston unengaged position.

Piston member 46 has a generally axial and planar inner diameter surface. The outer diameter surface of piston member 46 includes upper portion 50, expanded portion 52, and lower portion 54. The wall thickness and outer diameter of expanded portion 52 is greater than the wall thickness and outer diameter of both upper portion 50 and lower portion 54. The transition between expanded portion 52 and upper portion 50 defines an upper piston surface 56, which faces an upper downward facing sloped surface of housing central bore 18. The transition between expanded portion 52 and lower portion 54 defines a lower piston surface 58, which faces a lower upward facing sloped surface of housing central bore 18. In the embodiments of FIGS. 1-2 and 4, the lower upward facing sloped surface of housing central bore 18 is part of end cap 22.

Engage pressure chamber 60 is defined by the inner surface of housing central bore 18 and the outer surface of piston member 46, between upper piston surface 56 and the upper downward facing sloped surface of housing central bore 18. Ring seals are located axially above and below engage pressure chamber 60 to prevent pressure media from escaping between housing central bore 18 of connector housing 16, and the outer surface of piston member 46, so that the pressure integrity of engage pressure chamber 60 is maintained. Supply port 62 extends into engage pressure chamber 60 so that pressure media can be supplied to engage pressure chamber 60. When pressure media is supplied into engage pressure chamber 60, the pressure media will act on upper piston surface 56, moving piston member 46 downward towards the engaged position. The pressure media can be, for example, hydraulic fluid, pressurized air, or other suitable liquid or gas under pressure.

Similarly, release pressure chamber 64 is defined by the inner surface of housing central bore 18 and the outer surface of piston member 46, between lower piston surface 58 and the lower upward facing sloped surface of housing central bore 18. Ring seals are located axially above and below release pressure chamber 64 to prevent pressure media fern escaping between housing central bore 18 of connector housing 16, and the outer surface of piston member 46, so that the pressure integrity of release pressure chamber 64 is maintained. Release port 66 extends into release pressure chamber 64 so mat pressure media can be supplied to release pressure chamber 64. When pressure media is supplied into release pressure chamber 64, the pressure media will act on lower piston surface 58, moving piston member 46 upward towards the unengaged position.

Conductor pipe connector assembly 14 further includes a plurality of guide rods 68 for conveying movement of piston member 46 to movement of slip segment 28. Guide rods 68 are elongated, members spaced around a circumference of connector housing 16 and moveable in an axial direction only. Each guide rod 68 has a first end 70 coupled to piston member 46. In the embodiments of FIGS. 1-2 and 4, first end 70 of guide rod 68 is coupled to piston member 46 through carrier plate 72. Carrier plate 72 is located in a region of housing central bore 18 with a reduced wall thickness and increased inner diameter of connector housing 16. Carrier plate 72 is an annular member with an inner diameter that is threaded to an upper portion of piston member 46 and an outer diameter that is proximate to the inner surface of housing central bore 18. Carrier plate 72 moves axially with piston member 46 and first end 70 of each guide rod 68 is fastened to carrier plate 72 so that each guide rod 68 also moves axially with piston member 46.

Second end 74 of each guide rod 68 is linked to slip segment 28. In the embodiments of FIGS. 1-2 and 3, second end 74 of guide rod 68 is linked to slip segment 28 through slip carrier ring 76 and slip actuation ring 40. Slip carrier ring 76 is a ring shaped member located in an upper portion of bowl central bore 26 where an inner diameter of bowl central bore 26 is increased. Slip carrier ring 76 moves axially with piston member 46 and second end 74 is fastened to slip carrier ring 76 so that each guide rod 68 also moves axially with piston member 46. Slip carrier ring 76 has an inner profile that mates with an upper profile of slip actuation ring 40 so that slip actuation ting 40 moves axially with slip carrier ring 76, but as slip actuation ring 40 is moved axially downward, slip actuation ring 40 can move radially inward relative to slip carrier ring 76. Therefore movement of piston member 46 downwards towards the engaged position causes guide rods 68 to move slip segment 28 towards conductor pipe 10.

A middle portion 78 of each guide rod 68 is located within and extends through one of a plurality of elongated bores 80. Elongated bores 80 extend axially through a length of connector housing 16, offset from central axis 20. Elongated bores 80 provide a path for guide rods 68 and maintain guide rods 68 in a generally axial orientation.

In this way, as piston member 46 moves downward and towards an engaged position, guide rods 68 move slip segment 28 towards conductor pipe 10. This occurs by way of piston member 46 being connected to carrier plate 72, which in turn is coupled to first end 70 of guide rod 68, which has a second end 74 fastened to slip carrier ring 76, that mates with slip actuation ring 40, which urges slip segment 28 axially downward and radially inward towards conductor pipe 10. Simultaneously, the lower surface of piston member 46 engages annular seal 48, energizing annular seal 48, to seal between connector housing 16 and conductor pipe 10. When piston member moves in the opposite, upward direction, the engagement and mating of actuation surface profile 44 of actuation ring 40 with slips surface profile 42 of slip segment 28 retains slip segment 28 in engagement with slip actuation ring 40 when piston member 46 is moved towards the unengaged position.

Conductor pipe connector assembly 14 can in some embodiments, including the embodiments of FIGS. 1-2, include a plurality of lock members 82 spaced around and extending radially through connector housing 16. Lock members 82 can be, for example, pins with external threads that mate with internal threads of the bores of connector housing 16 through which lock members 82 extend. Each lock member 82 has a radially inner end that can engage a recess in an outer diameter surface of piston member 46. When the inner end of lock members 82 is so engaged, relative axial movement between connector housing 16 and piston member 46 is limited and the pressure media being injected into engage pressure chamber 60 can be ceased. Lock members 82 can retain piston member 46 in the engaged position.

In other embodiments, such as that of FIG. 4, conductor pipe connector assembly 14 does not have lock members 82. This provides for a smaller outer diameter profile of conductor pipe connector assembly 14, which may be desired when conductor pipe connector assembly 14 is utilized as an overshot for latching and gripping onto stuck pipe and therefore must pass within an annular space with limited radial width. In such cases, the pressure of pressure media being injected into engage pressure chamber 60 can be maintained to retain piston member 46 in the engaged position.

Returning to FIGS. 1-2 and 3, in order to connect flanged member 12 to conductor pipe 10, flanged member 12 is located adjacent to an upper end of connector housing 16. Annular gasket 86 is located between flanged member 12 and connector housing 16 to isolate any fluids within conductor pipe 10 and conductor pipe connector assembly 14 from the environment.

Looking now at FIG. 4, in certain embodiments, conductor pipe connector assembly 14 includes second annular seal 48' located within housing central bore 18. Second piston member 46' is also located within housing central bore 18 and is movable between a second piston unengaged position, and a second piston engaged position. In the second piston engaged position, second piston member 46' energizes second annular seal 48' to form a second seal between connector housing 16 and conductor pipe 10.

The outer diameter surface of second piston member 46' includes second upper portion 50', second expanded portion 52', and second lower portion 54'. The wall thickness and outer diameter of second expanded portion 52' is greater than the wall thickness and outer diameter of both second upper portion 50' and second lower portion 54'. The transition between second expanded portion 52' and second upper portion 50' defines a second upper piston surface 56', which faces a second upper downward facing sloped surface of housing central bore 18. In the embodiment of FIG. 4, the second upper downward facing sloped surface of housing central bore 18 is part of end cap 22. The transition between second expanded portion 52' and second lower portion 54' defines a second lower portion surface 58', which faces a second lower upward facing sloped surface of housing central bore 18. In the embodiment of FIG. 4, the second lower upward feeing sloped surface of housing central bore 18 is part of second end cap 22'.

Second engage pressure chamber 60' is defined by the inner surface of housing central bore 18 and the outer surface of second piston member 46', between second upper piston surface 56' and the second upper downward facing sloped surface of housing central bore 18. Ring seals are located axially above and below second engage pressure chamber 60' to prevent pressure media from escaping between housing central bore 18 of connector housing 16, and the outer surface of second piston member 46', so that the pressure integrity of second engage pressure chamber 60' is maintained. Second supply port 62' extends into second engage pressure chamber 60' so that pressure media can be supplied to second engage pressure chamber 60'. When pressure media is provided into second engage pressure chamber 60', the pressure media will act on second upper piston surface 56', moving second piston member 46' downward towards the engaged position where it engages and energizes second annular seal 48'.

Similarly, second release pressure chamber 64' is defined by the inner surface of housing central bore 18 and the outer surface of second piston member 46', between second lower piston surface 58' and the lower upward feeing sloped surface of housing central bore 18. Ring seals are located axially above and below second release pressure chamber 64' to prevent pressure media from, escaping between housing central bore 18 of connector housing 16, and the outer surface of second piston member 46', so that the pressure integrity of second release pressure chamber 64' is maintained. Second release port 66' extends into second release pressure chamber 64' so that pressure media can be supplied to second release pressure chamber 64'. When pressure media is pumped into second release pressure chamber 64', the pressure media will act on second lower piston surface 58', moving second piston member 46' upward towards the unengaged position.

In an example of operation, conductor pipe connector assembly 14 is assembled together with a pressure containing component through flanged end 84 of connector housing 16. The pressure containing component can be, for example, a surface wellhead component such as a casing head, a surface, or offshore member to be used with the conductor pipe connector assembly 14 when the conductor pipe connector assembly 14 is used as a overshot for latching and gripping onto stuck pipe, or a diverter system such as mini drilling stack when the conductor pipe connector assembly 14 is used for drilling applications.

Conductor pipe connector assembly 14 together with the pressure containing component is then run as one assembly and landed over and end of conductor pipe 10 so that connector housing 16 circumscribes a portion of conductor pipe 10. Pressure media is then injected into supply port 62 and into engage pressure chamber 60, to move piston member 46 downward and towards an engaged position. As pressure media is injected into supply port 62 and piston member 46 moves downward, any pressure media in release pressure chamber 64 escapes out of release port 66.

As piston member 46 travels downward, it is simultaneously performing two operations: annular seal 48 is energized to seal between connector housing 16 and conductor pipe 10, and slip segment 28 grips conductor pipe 10. Annular seal 48 is energized by squeezing annular seal 48 between the lower surface of piston member 46 and an annular upward facing surface of end cap 22, forcing annular seal 48 to exert a seal radially between end cap 22 of connector housing 16 and conductor pipe 10.

At the same time, as described above, as piston member 46 moves downward and towards an engaged position, guide rods 68 move slip segment 28 towards conductor pipe 10. This occurs by way of piston member 46 being connected to carrier plate 72, which in turn is coupled to first end 70 of guide rod 68, which has a second end 74 fastened to slip carrier ring 76, that mates with slip actuation ring 40, which urges slip segment 28 axially downward and radially inward towards conductor pipe 10.

Because slip segment 28 is controlled with a beneficial mechanical advantage, the downward motion of piston member 46 forces slip segment 28 radially inwards, biting conductor pipe 10. Slip actuation ring 40 can travel downwards until a tip at the bottom of slip actuation ring 40 bottoms out on an annular shoulder of slip bowl 24. The tip at the bottom of slip actuation ring 40 prevents slip segment from travelling so far downward that it becomes bound and can no longer be moved in an upward direction.

In embodiments where conductor pipe connector assembly 14 has a second annular seal 48', pressure media can also be provided into second engage pressure chamber 60' to move second piston member 46' downward towards the engaged position where it engages and energizes second annular seal 48'.

After Conductor pipe connector assembly 14 is set with piston member 46 in an engaged position, a test can be performed running a cup tester or equivalent tool. If annular seal 48, and second annular seal 48', as applicable, is not be able to withstand the pressure, annular seal 48 can be further energized by applying torque to lock members 82. By torqueing lock members 82, the lock members 82 will be driven inward until the radially inner end of lock members 82 engage the recess in the outer diameter surface of piston member 46. This recess is positioned so after the energization of annular seal 48 and slip segment 28, there is still sufficient stroke to allow the annular seal 48, and second annular seal 48', as applicable, to compress further as required. In embodiments without lock member 82, the pressure of the pressure medium engage pressure chamber 60 is maintained to maintain annular seal 48 in an energized condition and maintain slip segment 28 in gripping engagement with conductor pipe 10.

In order to reverse the process, pressure media can be injected through release port 66 and into release pressure chamber 64. During such operation, pressure media in engage pressure chamber 60 can escape out through supply port 62. Piston member 46 will move towards an unengaged position so that annular seal 48 is unenergized. Slips surface profile 42 and actuation surface profile 44 engage so that as slip actuation ring 40 moves upward, slip segment 28 moves upward with slip actuation ring 40. Therefore as piston member 46 moves upwards towards an unengaged position, slip segment 28 un-grips and releases conductor pipe 10.

Embodiments of this disclosure therefore provide a conductor connector with a quick makeup connection, that is weldless, and that utilizes hydraulic fluid to engaging the slip segment, whilst energizing the elastomer seals concurrently, all within a slim profile design.

The terms "vertical", "horizontal", "upward", "downward", "above", and "below" are used herein only for convenience because elements of embodiments of this disclosure may be utilized in various positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A conductor pipe connector assembly for coupling a pressure containing component to a conductor pipe of a subterranean well, the connector assembly comprising:

an annular slip bowl circumscribing the conductor pipe;

an annular slip segment between the slip bowl and the conductor pipe, the slip segment having an upward facing sloped surface with a slips surface profile and a downward facing sloped surface that mates with a bowl lower sloped surface of the slip bowl;

a slip actuation ring located radially between the slip bowl and the slip segment, the slip actuation ring having a downward facing sloped surface with an actuation surface profile in engagement with the slips surface profile of the slip segment, wherein the actuation surface profile has a saw tooth like sectional shape and mates with the slips surface profile, retaining the slip segment in engagement with the slip actuation ring when the piston member is moved towards an unengaged position; and an elongate annular piston member circumscribing the conductor pipe and coupled to the slip actuation ring, the piston member movable to an engaged position to urge the slip segment radially inward against the conductor pipe.

2. A conductor pipe connector assembly in accordance with claim 1, further comprising:

a connector housing circumscribing the conductor pipe, the connector housing being annular with a housing central bore; and an engage pressure chamber defined between the piston member and the connector housing, the engage pressure chamber being in fluid communication with a supply port, wherein a pressure media selectively supplied to the engage pressure chamber will move the piston member towards the engaged position.

3. A conductor pipe connector assembly in accordance with claim 1, further comprising:

a connector housing circumscribing the conductor pipe, the connector housing being annular with a housing central bore; and a release pressure chamber defined between the piston member and the connector housing, the release pressure chamber being in fluid communication with a release port, wherein a pressure media operably supplied to the release pressure chamber will move the piston member towards an unengaged position.

4. A conductor pipe connector assembly in accordance with claim 1, further comprising an annular seal between the conductor pipe and a connector housing that circumscribes the conductor pipe axially above the slip bowl, and wherein the annular seal is energized into a sealing configuration by the piston member when the piston member is in the engaged position.

5. A conductor pipe connector assembly in accordance with claim 1, further comprising:

a connector housing circumscribing the conductor pipe, the connector housing being annular with a housing central bore;

a plurality of guide rods spaced around a circumference of the connector housing, the guide rods having a first end coupled to the piston member and a second end linked to the slip segment; and wherein movement of the piston member towards the engaged position causes the guide rods to move the slip segment towards the conductor pipe.

6. A conductor pipe connector assembly in accordance with claim 5, further comprising a plurality of elongated bores extending axially through a length of the connector housing offset from a central axis, and wherein a middle portion of the each of the guide rods extends through one of the elongated bores.

7. A conductor pipe connector assembly in accordance with claim 1, wherein the slip segment is generally ring shaped with a gap extending through its axial length, the slip segment being biased in a radially outward direction, retaining contact with the slip bowl.

8. A conductor pipe connector assembly in accordance with claim 1, further comprising:

a connector housing circumscribing the conductor pipe, the connector housing being annular with a housing central bore;

a flanged member located adjacent to an upper end of the connector housing and connected to the pressure containing component; and an annular gasket located between the flanged member and the connector housing.

9. A conductor pipe connector assembly in accordance with claim 1, further comprising:

a connector housing circumscribing the conductor pipe, the connector housing being annular with a housing central bore;

a second annular seal located within the housing central bore; and a second piston member located within the housing central bore, the second piston member being movable between a second piston unengaged position, and a second piston engaged position where the second piston member energizes the second annular seal to form a second seal between the connector housing and the conductor pipe.

10. A conductor pipe connector assembly for coupling a pressure containing component to a conductor pipe of a subterranean well, the connector assembly comprising:

a connector housing, the connector housing being annular with a housing central bore and a central axis;

a slip bowl located axially adjacent to, attached to, and coaxial with, the connector housing, the slip bowl being annular and having a bowl central bore;

a slip segment carried within the bowl central bore;

an annular seal located within the housing central bore;

a piston member located within the housing central bore, the piston member being an elongated annular member movable to an engaged position where the piston member both energizes the annular seal to seal between the connector housing and the conductor pipe and retains the slip segment in gripping engagement with the conductor pipe;

a plurality of guide rods spaced around a circumference of the connector housing; wherein the piston member includes a carrier plate located at an upper end of the piston member, a first end of the guide rods being secured to the carrier plate;

the conductor pipe connect- assembly includes a slip carrier ring located in the bowl central bore the slip carrier ring being a ring shaped member engaging the slip segment and a second end of the guide rods being secured to the slip carrier ring; and movement of the piston member towards an engaged position causes the guide rods to move the slip segment towards the conductor pipe.

11. A conductor pipe connector assembly in accordance with claim 10, further comprising:

an engage pressure chamber defined between the piston member and the connector housing, the engage pressure chamber being in fluid communication with a supply port, wherein a pressure media selectively supplied to the engage pressure chamber will move the piston member towards the engaged position; and a release pressure chamber defined between the piston member and the connector housing, the release pressure chamber being in fluid communication with a release port, wherein a pressure media operably supplied to the release pressure chamber will move the piston member towards the unengaged position; and ring seals located on upper and lower sides of both the engage pressure chamber and the release pressure chamber to seal between the piston member and the connector housing.

12. A conductor pipe connector assembly in accordance with claim 10, further comprising:

a second annular seal located within the housing central bore; and a second piston member located within the housing central bore, the second piston member being movable between a second piston unengaged position, and a second piston engaged position where the second piston member energizes the second annular seal to form a second seal between the connector housing and the conductor pipe.

13. A method for coupling a pressure containing component to a conductor pipe of a subterranean well, the method comprising:

providing a conductor pipe connector assembly, the conductor pipe connector assembly having a connector housing with a housing central bore, a slip bowl attached to, and coaxial with, the connector housing and having a bowl central bore, a slip segment carried within the bowl central bore, a slip actuation ring located radially between the slip bowl and the slip segment, an annular seal located within the housing central bore, and a piston member located within the housing central bore, wherein the slip segment has an upward facing sloped surface with a slips surface profile and a downward facing sloped surface that mates with and slides along a bowl lower sloped surface;

landing the conductor pipe connector assembly over an end of the conductor pipe so that the connector housing circumscribes a portion of the conductor pipe; and injecting a pressure media into a supply port through the connector housing and into an engage pressure chamber defined between the piston member and the connector housing, to move the piston member towards an engaged position so that the annular seal is energized to seal between the connector housing and the conductor pipe, and the slip segment grips the conductor pipe by moving the slip actuation ring so that a downward facing sloped surface with an actuation surface profile of the slip actuation ring is in engagement with and moves along the slips surface profile of the slip segment.

14. A method in accordance with claim 13, further comprising injecting the pressure media into a release port through the connector housing and into a release pressure chamber defined between the piston member and the connector housing to move the piston member towards an unengaged position so that the annular seal is unenergized and the slip segment un-grips the conductor pipe.

15. A method in accordance with claim 13, wherein the conductor pipe connector assembly further comprises a plurality of lock members spaced around and extending radially through the connector housing, the method further comprising engaging the piston member with a radially inner end of the lock member to limit relative axial movement between the connector housing and the piston member.

16. A method in accordance with claim 13, wherein the conductor pipe connector assembly further comprises a plurality of guide rods spaced around a circumference of the connector housing, the guide rods having a first end coupled to the piston member and a second end linked to the slip segment, the method further comprising moving the slip segment towards the conductor pipe with the guide rods.

17. A method in accordance with claim 13, the method further comprising maintaining a pressure of the pressure media in the engage pressure chamber to maintain the annular seal in an energized condition and maintain the slip segment in gripping engagement with the conductor pipe.

18. A method in accordance with claim 13, wherein the conductor pipe connector assembly further comprises a second annular seal located within the housing central bore and a second piston member located within the housing central bore, the method further comprising injecting a pressure media into a second supply port to move the second piston member to an engaged position where the second piston member energizes the second annular seal to form a second seal between the connector housing and the conductor pipe.

* * * * *